US007125199B2

(12) United States Patent
Kang

(10) Patent No.: US 7,125,199 B2
(45) Date of Patent: Oct. 24, 2006

(54) ELASTIC PERMEABLE PAVEMENT COMPRISING WASTE-POLYURETHANE CHIPS FOR USE ON NEW ROADS AND A PAVING METHOD USING THE SAME

(76) Inventor: Sung Soon Kang, #304 Hojeong Villa, 679 Ilwon-dong, Kangnam-gu, Seoul (KR) 135-230

( * ) Notice: Subject to any disclaimer, the term of this patent is extended or adjusted under 35 U.S.C. 154(b) by 0 days.

(21) Appl. No.: 10/805,563

(22) Filed: Mar. 19, 2004

(65) Prior Publication Data

US 2006/0140720 A1 Jun. 29, 2006

(30) Foreign Application Priority Data

Feb. 6, 2004 (KR) ..... 10-2004-0007860

(51) Int. Cl.
*E01C 7/30* (2006.01)
*E01C 15/00* (2006.01)

(52) U.S. Cl. ..... 404/27; 404/32; 404/82; 427/136

(58) Field of Classification Search ..... 404/17, 404/18, 27–36, 44, 72, 82; 427/136–139
See application file for complete search history.

(56) References Cited

U.S. PATENT DOCUMENTS

| | | | | |
|---|---|---|---|---|
| 3,645,945 | A * | 2/1972 | Lesesne | 524/705 |
| 6,960,046 | B1 * | 11/2005 | Kang | 404/44 |
| 2005/0175410 | A1 * | 8/2005 | Kang | 404/44 |

* cited by examiner

*Primary Examiner*—Meredith C. Petravick
*Assistant Examiner*—Alexandra Pechhold
(74) *Attorney, Agent, or Firm*—Madson & Austin

(57) ABSTRACT

An elastic permeable pavement comprising waste-polyurethane chips for use on new roads and a paving method using the same. This pavement uses a binder specially developed to secure the binding between an upper polyurethane chip layer and a lower permeable concrete layer as well as the binding among the waste-polyurethane chips, resulting in excellent strength and durability, and uses recycled polyurethane chips to provide elasticity and permeability suitable for sports activities, walking, and outdoor exercises.

18 Claims, No Drawings

ELASTIC PERMEABLE PAVEMENT COMPRISING WASTE-POLYURETHANE CHIPS FOR USE ON NEW ROADS AND A PAVING METHOD USING THE SAME

FIELD OF THE INVENTION

The present invention relates to an elastic permeable pavement comprising waste-polyurethane chips for use on new roads and a paving method using the same. This pavement uses a binder specially developed to secure the binding between an upper polyurethane chip layer and a lower permeable concrete layer as well as the binding among the waste-polyurethane chips, resulting in excellent strength and durability, and uses recycled waste-polyurethane chips to provide elasticity and permeability suitable for sports activities, walking, outdoor exercises and the like.

BACKGROUND OF THE INVENTION

In general, a permeable concrete comprises aggregates of the size generally less than 13 mm to maintain suitable porosity and strength, and is used as a material for pavement allowing water to seep into the ground through a surface layer and a base layer of the pavement. Specifically, the permeable concrete allows rain or water to seep into the ground through pores among the aggregates, fostering the growth of trees and plants, and also helps prevent flooding of the river by allowing heavy or torrential rain to flow under the earth. Further, because the rain or water does not stay on the permeable concrete pavement, it provides less slippery and much safer walking, jogging or driving conditions.

For these reasons, the permeable concrete pavement has come into use more widely, especially on trails at parks, bicycle paths, tracks for in-line skating, golf-course trails, etc.

Conventional permeable pavements are divided into permeable asphalt concrete and permeable cement concrete. However, the asphalt concrete has disadvantages in that the surface deforms considerably due to high temperatures during the summer season and the pores get clogged up due to the viscosity of the asphalt. Also, the cement concrete is so rigid that people can hurt when they fall on it.

In addition, the conventional permeable concrete pavement is covered with epoxy pigments for cosmetic view of the surface, but a ramp covered with such epoxy pigments is more slippery than normal concrete pavement, causing problems in safety.

Further, because the surface of the concrete pavement is rugged, the surface can peel or break off, and when the pores are covered with dust, the pavement's permeability deteriorates, requiring additional maintenance costs for declogging the pores, i.e. removal of the dust.

As an example to improve the disadvantages of the conventional permeable concrete, Korean Patent No. 404679 (patented on Oct. 27, 2003 entitled "pavement using waste tire chips") discloses an elastic permeable pavement which comprises a land layer, a filter layer, a rubble layer, a permeable concrete layer, a waste-polyurethane chip layer, and a surface layer from the bottom to the top. Specifically, the filter layer is constructed by spreading small aggregates (sand), and the rubble layer is constructed by pouring and hardening concrete rubbles of the particle size 25 mm or less onto the filter layer. The permeable concrete layer is made by blending aggregates of the particle size 5–13 mm, cement and admixture products with water, and pouring this mixture on the rubble layer and curing it. As a result, the permeable concrete layer has the compressive strength of 100 kg/cm$^2$ or more and the permeability coefficient of $1\times10^{-3}$ cm/sec or more. Further, the waste-tire chip layer is formed by pouring and spreading in the thickness of 10–20 mm a mixture including waste-tire chips of particle size 2.5–7 mm; a binder comprising 10–25 g of urethane resin, epoxy resin or acrylic resin based on 100 g of the waste tire chips; and 1–4 g of an inorganic pigment on the same base. Furthermore, the surface layer is colored by spraying with the urethane resin, epoxy resin or acrylic resin on the waste-tire chip layer.

The elastic permeable pavement as disclosed in the above patent allows rain or water to penetrate into the ground, and the pavement is resistant to slipping and reduces diffused light-reflection resulted from the water staying on the pavement, thus securing safe passage of pedestrians and providing comfortable vision. Also, as using waste tires which have been one of the environmental pollutants, the pavement not only absorbs impact on foot, but also contributes to the protection of environment and recycling of resources.

However, since the waste tire's smell of rubber lasted for a long time, the pavement using the waste tire could not provide a pleasant sense of smell. Further, since the urethane, epoxy and acrylic resin binders used in the above patent were those available in the market, there have been demands for a special binder which enhances the adhesive strength among pavement materials and maintains the strength and durability of the pavement for a long time.

Accordingly, the inventor of the present invention studied and researched into materials and binders for the elastic permeable pavement, and as a result, the inventor completed the present invention by using waste-polyurethane chips in place of waste-tire chips as a main component of the elastic pavement and developing a binder to secure the binding between an upper polyurethane-chip layer and a lower permeable-concrete layer as well as the binding among the waste-polyurethane chips.

SUMMARY OF THE INVENTION

The object of the present invention is to provide an elastic permeable pavement, which uses waste-polyurethane chips obtained from soles of shoes, parts of toys, parts of refrigerators and vehicles and decrepit recycled-polyurethane resilient pavement to solve the smelling problem of waste tires, nurse resources and prevent environmental pollution, and to provide comfort and shock absorption in walking as well.

Another object of the present invention is to provide an elastic permeable pavement and its paving method, which uses a binder specially developed to secure the binding between an upper polyurethane-chip layer and a lower permeable-concrete layer as well as the binding among the waste-polyurethane chips, resulting in excellent strength and durability.

A further object of the present invention is to provide an elastic permeable pavement for use on new roads, which comprises an upper polyurethane-chip layer and a lower permeable-concrete layer to allow rain or water to seep into the ground, thus providing safer walking, jogging or driving conditions and comfortable vision, and also preventing flooding of the river due to heavy rain.

In order to achieve the above objects, the elastic permeable pavement for use on new roads according to the present invention comprises a land layer; a filter layer comprising small aggregates; a base layer comprising rubbles for concrete of the size 25 mm or less; a permeable concrete layer comprising aggregates of the size in the range of 5–13 mm, cement, water and admixture products; a primer layer; and an elastic layer from the bottom to the surface, wherein the permeable concrete layer has the compressive strength of 100 $kg/cm^2$ or more and the permeability coefficient of $1\times10^{-3}$ cm/sec or more; the primer layer comprises 10–20% by weight of PPG(polypropylene glycol), 5–10% by weight of TMP (trimethylol propane), 5–10% by weight of 1,3-BG (1,3-butylene glycol), 15–25% by weight of TDI (toluene diisocyanate), 49–64.9% by weight of a solvent (xylene or methylethylketone) and 0.1–1.0% by weight of an additive (defoaming agent); and the elastic layer is prepared by mixing waste-polyurethane chips and a binder in the weight ratio of 3:1 to 4:1, the waste-polyurethane chips having the size of 1 to 5 mm, and the binder comprising 50–70% by weight of PPG, 5–10% by weight of PBG (polybutadiene glycol), 3–5% by weight of 1,3-BG, 20–30% by weight of MDI (methylene diisocyanate) and 2–5% by weight of TDI.

In addition, according to the present invention, a method of paving the elastic permeable pavement on new roads is provided, which comprises piling up a land layer, a filter layer comprising small aggregates, a base layer comprising rubbles for concrete of the rubble size 25 mm or less, a permeable concrete layer comprising aggregates of the size in the range of 5–13 mm, cement, water and admixture products, and an elastic layer from the bottom to the surface, wherein a primer layer comprising 10–20% by weight of PPG, 5–10% by weight of TMP, 5–10% by weight of 1,3-BG, 15–25% by weight of TDI, 49–64.9% by weight of a solvent (xylene or methylethylketone) and 0.1–1.0% by weight of an additive (defoaming agent) is spread on the permeable concrete layer before pouring the elastic layer, and wherein the elastic layer is prepared by mixing waste-polyurethane chips and a binder in the weight ratio of 3:1 to 4:1, the waste-polyurethane chips having the size of 1 to 5 mm and the binder comprising 50–70% by weight of PPG, 5–10% by weight of PBG, 3–5% by weight of 1,3-BG, 20–30% by weight of MDI and 2–5% by weight of TDI; after spreading the elastic layer, pressing the elastic layer with a roller of 20–30 kg heated to temperatures of 50–80° C. and trowelling the layer in the same temperature; and then curing for about 5 to 24 hours.

The waste-polyurethane chips used in the present invention are obtained by collecting waste-polyurethane scraps from soles of shoes, parts of toys, parts of refrigerators and vehicles, decrepit polyurethane resilient pavement, etc. and separating the scraps according to their colors; removing impurities attached on the scraps; pulverizing the waste-polyurethane scraps in a predetermined size; mixing the scraps with 0.3–1.0 kg of stearic acid, 20–30 kg of heavy calcium carbonate, 0.1–2.0 kg of titanium dioxide as a decolorant and white pigment and 5 kg or less of a pigment, based on 100 kg of the pulverized waste-polyurethane scraps by stirring; heating and extruding the mixture; and then condensing and cutting the extruded mixture into a predetermined size.

In the present invention, a photoluminescent pigment, which emits light at night or darkness in case of rain by using the energy that has been accumulated during the daytime, can be used as the pigment, and zinc sulfide compounds can be used for this purpose. In this case, the amount of the photoluminescent pigment used is 20–40% by weight of the scraps.

For instance, waste-polyurethane chips made by using the photoluminescent pigment can be prepared separately from the chips made by using a normal pigment in a predetermined ratio, and they can be mixed with the binder respectively at a construction site, so that they can be distributed and spread in their respective positions that have been designed previously.

If a flame retarding property is required in preparing the waste-polyurethane chips, a flame retardant in the range of 1–2% by weight of the scraps can be added to the mixture.

Further, depending on usages of the elastic drainage pavement, a foaming agent can be used to adjust the hardness of the waste-polyurethane chips. For example, the waste-polyurethane chips made by using a relatively large amount of the foaming agent can be used for sidewalks and trails, while the relatively hard polyurethane chips made by using less amount of the foaming agent can be used for bicycle paths and tracks for in-line skating.

The size of the waste-polyurethane chips can vary according to their usage, e.g., in 1–2 mm, 2–3 mm, 3–4 mm, 1–5 mm, etc. Smaller ones can be used for bicycle paths and tracks for in-line skating, and larger ones for sidewalks and trails. In particular, the polyurethane chips for trails may be formed in part or entirely in the shape of a strand having the length of 10–30 mm and the thickness of 1–3 mm, so that the chips can form large pores, providing more cushion and enhancing the permeability.

The waste-polyurethane chips in the elastic drainage layer can be replaced in part or entirely with new polyurethane chips. The new polyurethane chips are prepared by mixing 1 part by weight of liquid polyurethane with 0.5–1.2 parts by weight of heavy calcium carbonate, and 0.01 part by weight or less of a pigment or 0.1–0.4 parts by weight of a photoluminescent pigment by stirring; pouring the mixture into a mold and curing in a sheet form; and then cutting and pulverizing the polyurethane sheet into a predetermined size. The new polyurethane chips manufactured as such are very clear in color.

In addition, the binder used in the present invention is to secure the binding between the elastic drainage layer and the existing pavement and also among the waste-polyurethane chips in the elastic drainage layer. Usually, compounds having molecular weight of 1,000–5,000 and having more than two hydroxy groups (—OH) or multi-functional isocyanate compounds (—NCO) are used as the binder.

For example, TDI and MDI are used as the chip binders. However, the adhesive property and the coefficient of expansion of the binders are variable depending on their molar ratio. Therefore, the inventor of the present invention developed a binder suitable for achieving the objects of the invention and having the elasticity and the coefficient of expansion similar to those of the polyurethane chips to provide an excellent adhesive property among the chips. This specially developed binder according to the present invention comprises 50–70% by weight of PPG, 5–10% by weight of PBG, 3–5% by weight of 1,3-BG, 20–30% by weight of MDI and 2–5% by weight of TDI, wherein PPG is to provide toughness and 1,3-BG is used as a chain extender to form a polymer having higher molecular weight than a simple compound produced by the reaction between PPG and MDI. The binder of the present invention, therefore, does not only have a high adhesiveness and coefficient of expansion, but also has tensile strength and pliability from a primary reaction with MDI and a secondary reaction with TDI.

It is preferable that the polyurethane chips and the binder are blended in the weight ratio of 3:1 to 4:1. This is because use of the binder less than 20% by weight results in poor adhesive property, and use of more than 40% causes the pores to be clogged or the binder to be blown up during the curing step.

DETAILED DESCRIPTION OF THE PREFERRED EMBODIMENTS

The principal of the present invention will be described in more detail below with reference to the embodiments, but the scope of the invention is not limited within the embodiments.

1. Preparation of Waste-polyurethane Chips

As a preliminary step, waste-polyurethane scraps were collected from soles of shoes, parts of toys, parts of refrigerators and vehicles, decrepit polyurethane resilient pavement, etc., and separated according to their colors. From the separated waste-polyurethane scraps, impurities stuck thereto were removed by cutting.

Then, the waste-polyurethane scraps were pulverized in a crusher into the particle diameter of 3–30 mm, and transported to a mixer.

Based on 100 kg of the pulverized waste-polyurethane scraps, 0.5 kg of stearic acid, 25 kg of heavy calcium carbonate, 0.2 kg of titanium dioxide and 1.5 kg of a pigment were added and mixed by stirring.

Then, the mixture was transported through a conveyor to an extruder where the mixture was extruded in the form of a plate.

The extruded waste-polyurethane was passed to a second crusher and a cutter to be cut in the particle size of 1–5 mm, resulting in the production of waste-polyurethane chips.

In this embodiment, if the flame retarding property is required, a flame retardant in the range of 1–2% by weight of the scraps can be added to the mixture.

2. Preparation of Binder 30 kg of PPG and 5 kg of PBG were prepared as polyol compounds. Also, 13 kg of MDI and 2 kg of TDI as multi-functional isocyanate compounds and 2 kg of 1,3-BG as a chain extender were prepared.

The above compounds were mixed with an accelerator and reacted to produce a binder having the following physical properties:

| Physical property (unit) | Result |
|---|---|
| Blending ratio | 1-part liquid |
| Solid in mixture (%) | 97 ± 3 |
| Appearance | transparent light yellow |
| Viscosity (Cps/25° C.) | 2500 ± 500 |
| Specific gravity | 1.00 ± 0.10 |
| Working life (min) | 30 ± 10 |
| Time for curing (hr) | 12 ± 3 |
| Coefficient of expansion (%) | 100 ± 50 |
| Tensile strength (kg/cm$^2$) | 10 ± 5 |
| Tear strength (kg/cm) | 7 ± 3 |

3. Elastic Permeable Pavement

[Embodiment 1]

From the bottom, a land layer, a filter layer comprising small aggregates, and a base layer comprising rubbles for concrete of the rubble size 25 mm or less were piled up.

Above the base layer, a concrete mixture comprising aggregates of the size in the range of 5–13 mm, cement, water and admixture products was poured to form a permeable concrete layer.

Then, a primer composition prepared by mixing 5 kg of PPG, 3 kg of TMP, 2 kg of 1,3-BG, 7 kg of TDI, 17 kg of xylene as a solvent and 0.3 kg of a defoaming agent was spread on the permeable concrete layer.

In order to form an elastic layer above the permeable concrete layer, 100 kg of the waste-polyurethane chips having the size of 1 to 3 mm and 30 kg of the binder were blended in situ.

This mixture was poured onto the primer layer and spread in the thickness of 10–20 mm, and the mixtures was pressed with a roller of 30 kg which has been heated to temperatures of about 80° C. and trowelled at the same temperature. Then, the pavement was cured for about 24 hours, during which the construction site was closed to traffic.

The elastic permeable pavement obtained as such had the strength and elasticity suitable for bicycle paths and tracks for in-line skating.

[Embodiment 2]

In order to form an elastic permeable pavement suitable for walking, the waste-polyurethane chips having the size of 3 to 5 mm on average and those having the length of 15 mm and the thickness of 1 mm in a strand form were prepared and respectively blended with the binder in the ratio of 3:1 in situ. The rest of the steps were taken in the same manner as in Embodiment 1

As a result, the elastic permeable pavement suitable for walking was obtained, and this pavement had pores larger than that produced in Embodiment 1 and was softer and more permeable.

[Embodiment 3]

In this embodiment, in order to form an elastic permeable pavement suitable for walking, the waste-polyurethane chips having the size of 3 to 5 mm on average were prepared by using a normal pigment and the chips having the same size were separately prepared by using a photoluminescent pigment (zinc sulfide), each of which were then blended with the binder in the ratio of 3:1 in situ.

The waste-polyurethane chip mixture using the normal pigment was poured in the thickness of 10–20 mm outside of a frame, e.g. a star shape frame, which has been preliminarily placed on the primer layer, and the waste-polyurethane chip mixture using the photoluminescent pigment was poured inside of the frame. Then, the both poured chips were pressed with a roller of 30 kg heated to temperatures of about 80° C. and trowelled at the same temperature.

As a result, the elastic permeable pavement obtained had the strength and optimum elasticity suitable for trails. Further, as the photoluminescent polyurethane chips could be disposed in various constellations, the chips emit light in the evening or at night, providing visual pleasure for pedestrians and helping students or children to study constellations.

[Embodiment 4]

50 kg of the waste-polyurethane chips obtained from the above Embodiment 1 was used together with 50 kg of polyurethane chips prepared by using new polyurethane material to be blended with the binder.

The urethane chips using the new polyurethane material were prepared by mixing 50 kg of liquid polyurethane with 35 kg of heavy calcium carbonate and 0.5 kg of a pigment in a high-speed stirrer of more than 1000 rpm, pouring and curing the mixture in a frame in the shape of a plate, and then pulverizing the cured mixture into the particle size of 3–5 mm.

The other procedures were the same as in Embodiment 1, and as a result the elastic permeable pavement in much clearer color was obtained.

As described above, the elastic permeable pavement according to the present invention, which uses waste-polyurethane chips obtained from soles of shoes, parts of toys, parts of refrigerators and vehicles and decrepit recycled polyurethane resilient pavement, solves the smelling problem of waste tires, nurses resources and prevents environmental pollution, and also provides comfort and shock absorption in walking.

Further, according to the present invention, the elastic permeable pavement and its paving method use the binder specially developed to secure the binding between the polyurethane chip layer and the permeable concrete layer as well as the binding among the waste-polyurethane chips, resulting in excellent strength and durability.

Furthermore, the elastic permeable pavement for use on new roads according to the present invention, which comprises an upper polyurethane chip layer and a lower permeable concrete layer, allows rain or water to seep into the ground, thus providing safer walking, jogging or driving conditions and comfortable vision, and also preventing flooding of the river due to heavy rain.

It will be apparent to those skilled in the art that various modifications and variations can be made to the present invention without departing from the spirit and scope of the invention. The present invention covers the modifications and variations thereof provided they come within the scope of the appended claims and their equivalents.

The invention claimed is:

1. Elastic permeable pavement for use on new roads comprising a land layer; a filter layer comprising small aggregates; a base layer comprising rubbles for concrete of the rubble size 25 mm or less; a permeable concrete layer comprising aggregates of the size in the range of 5–13 mm, cement, water and admixture products; a primer layer; and an elastic layer from the bottom to the surface, wherein the permeable concrete layer has the compressive strength of 100 kg/cm$^2$ or more and the permeability coefficient of $1\times10^{-3}$ cm/sec or more;

the primer layer comprises 10–20% by weight of polypropylene glycol, 5–10% by weight of trimethylol propane, 5–10% by weight of 1,3-butylene glycol, 15–25% by weight of toluene diisocyanate, 49–64.9% by weight of a solvent which is either xylene or methylethylketone and 0.1–1.0% by weight of a deoaming agent; and the elastic layer is prepared by mixing waste-polyurethane chips and a binder in the weight ratio of 3:1 to 4:1, the waste-polyurethane chips having the size of 1 to 5 mm, and the binder comprising 50–70% by weight of polypropylene glycol, 5–10% by weight of polybutadiene glycol, 3–5% by weight of 1,3-BG, 20–30% by weight of methylene diisocyanate and 2–5% by weight of toluene diisocyanate.

2. Elastic permeable pavement as claimed in claim 1, wherein the waste polyurethane chips are obtained by collecting waste-polyurethane scraps from soles of shoes, parts of toys, parts of refrigerators and vehicles, decrepit polyurethane resilient pavement, etc. and separating the scraps according to their colors; removing impurities attached on the scraps; pulverizing the waste-polyurethane scraps into a predetermined size; mixing the scraps with 0.3–1.0 kg of stearic acid, 20–30 kg of heavy calcium carbonate, 0.1–2.0 kg of titanium dioxide and 5 kg or less of a pigment or 20–40 kg of a photoluminescent pigment, based on 100 kg of the pulverized waste-polyurethane scraps by stirring; heating and extruding the mixture in the form of a plate; and then condensing and cutting the extruded mixture in the size of 1 to 5 mm.

3. Elastic permeable pavement as claimed in claim 2, wherein a flame retardant is added to the mixture in the range of 1–2% by weight of the scraps in preparing the waste-polyurethane chips.

4. Elastic permeable pavement as claimed in claim 2, wherein depending on usages of the elastic pavement, a foaming agent is used to adjust the hardness of the waste-polyurethane chips.

5. Elastic permeable pavement as claimed in claim 3, wherein depending on usages of the elastic pavement, a foaming agent is used to adjust the hardness of the waste-polyurethane chips.

6. Elastic permeable pavement as claimed in claim 2, wherein the waste-polyurethane chips are cut in the shape of a strand having the length of 10–30 mm and the thickness of 1–3 mm to be used in part with or in place of the waste-polyurethane chips having the size of 1 to 5 mm.

7. Elastic permeable pavement as claimed in claim 3, wherein the waste-polyurethane chips are cut in the shape of a strand having the length of 10–30 mm and the thickness of 1–3 mm to be used in part with or in place of the waste-polyurethane chips having the size of 1 to 5 mm.

8. Elastic permeable pavement as claimed in claim 1, wherein the waste-polyurethane chips can be replaced in part with new polyurethane chips.

9. Elastic permeable pavement as claimed in claim 2, wherein the waste-polyurethane chips can be replaced in part with new polyurethane chips.

10. Elastic permeable pavement as claimed in claim 8, wherein the new polyurethane chips are prepared by mixing 1 part by weight of liquid polyurethane with 0.5–1.2 parts by weight of heavy calcium carbonate, and 0.01 part by weight or less of a pigment or 0.1–0.4 parts by weight of a photoluminescent pigment; pouring the mixture in a mold and curing in a sheet form; and then pulverizing the polyurethane sheet into the particle size of 1–5 mm.

11. Elastic permeable pavement as claimed in claim 9, wherein the new polyurethane chips are prepared by mixing 1 part by weight of liquid polyurethane with 0.5–1.2 parts by weight of heavy calcium carbonate, and 0.01 part by weight or less of a pigment or 0.1–0.4 parts by weight of a photoluminescent pigment; pouring the mixture in a mold and curing in a sheet form; and then pulverizing the polyurethane sheet into the particle size of 1–5 mm.

12. A method of paving the elastic permeable pavement on new roads as defined in claim 1, the method comprising the steps of:

piling up the land layer, the filter layer, the base layer, the permeable concrete layer, and the elastic layer from the bottom to the surface, wherein the primer layer is spread on the permeable concrete layer before pouring the elastic layer;

after spreading the elastic layer, pressing the elastic layer with a roller of 20–30 kg heated to temperatures of 50–80° C. and trowelling the layer in the same temperature; and then curing for about 5 to 24 hours.

13. A method of paving elastic permeable pavement as claimed in claim 12, wherein the waste-polyurethane chips are obtained by collecting waste-polyurethane scraps from soles of shoes, parts of toys, parts of refrigerators and vehicles, decrepit polyurethane resilient pavement, etc. and separating the scraps according to their colors; removing impurities attached on the scraps; pulverizing the waste-polyurethane scraps into a predetermined size; mixing the scraps with 0.3–1.0 kg of stearic acid, 20–30 kg of heavy calcium carbonate, 0.1–2.0 kg of titanium dioxide and 5 kg or less of a pigment or 20–40 kg of a photoluminescent pigment, based on 100 kg of the pulverized waste-polyurethane scraps by stirring; heating and extruding the mixture in the form of a plate; and then condensing and cutting the extruded mixture in the size of 1 to 5 mm.

14. A method of paving elastic permeable pavement as claimed in claim 13, wherein the waste-polyurethane chips made by using the pigment and the waste-polyurethane chips made by using the photoluminescent pigment are separately prepared and respectively mixed with the binder, so that they can be separately distributed and spread in their predetermined positions.

15. A method of paving elastic permeable pavement as claimed in claim 12, herein the waste-polyurethane chips can be replaced in part with new polyurethane chips.

16. A method of paving elastic permeable pavement as claimed in claim 13, herein the waste-polyurethane chips can be replaced in part with new polyurethane chips.

17. A method of paving elastic permeable pavement as claimed in claim 15, wherein the new polyurethane chips are prepared by mixing 1 part by weight of liquid polyurethane with 0.5–1.2 parts by weight of heavy calcium carbonate, and 0.01 part by weight or less of a pigment or 0.1–0.4 parts by weight of a photoluminescent pigment; pouring the mixture in a mold and curing in a sheet form; and then pulverizing the polyurethane sheet into the particle size of 1–5 mm.

18. A method of paving elastic permeable pavement as claimed in claim 16, wherein the new polyurethane chips are prepared by mixing 1 part by weight of liquid polyurethane with 0.5–1.2 parts by weight of heavy calcium carbonate, and 0.01 part by weight or less of a pigment or 0.1–0.4 parts by weight of a photoluminescent pigment; pouring the mixture in a mold and curing in a sheet form; and then pulverizing the polyurethane sheet into the particle size of 1–5 mm.

* * * * *